US008245642B2

(12) United States Patent
Alculumbre

(10) Patent No.: US 8,245,642 B2
(45) Date of Patent: Aug. 21, 2012

(54) PROJECTILE SAFETY SYSTEM

(75) Inventor: Michael Alculumbre, London (GB)

(73) Assignee: Olympic Technologies Limited (GI)

( * ) Notice: Subject to any disclaimer, the term of this patent is extended or adjusted under 35 U.S.C. 154(b) by 276 days.

(21) Appl. No.: 12/620,152

(22) Filed: Nov. 17, 2009

(65) Prior Publication Data

US 2010/0147176 A1 Jun. 17, 2010

(30) Foreign Application Priority Data

Dec. 17, 2008 (GB) ..... 0822973.4

(51) Int. Cl.
*F42C 15/34* (2006.01)

(52) U.S. Cl. ..... 102/256; 102/222; 102/244

(58) Field of Classification Search ..... 102/222, 102/254, 256, 244, 439
See application file for complete search history.

(56) References Cited

U.S. PATENT DOCUMENTS 6,604,467 B2 * 8/2003 Alculumbre et al. ..... 102/249
7,360,486 B2 * 4/2008 Alculumbre et al. ..... 102/244

FOREIGN PATENT DOCUMENTS

WO 99/51934 10/1999
WO 2004/065891 A2 8/2004

* cited by examiner

*Primary Examiner* — Michael David
(74) *Attorney, Agent, or Firm* — Studebaker & Brackett PC; Donald R. Studebaker

(57) ABSTRACT

A small arms projectile for a small arms weapon is provided within a cartridge cover (1). A release element (15) is provided for preventing movement of the projectile's initiator (11) into an armed position. A channel (5) is formed between the initiator (11) and the projectile's explosive charge (8) and a slidable shield (6) is provided therein. An insert element (10) is also located in the channel for preventing movement of the shield (6) into its armed position. The insert element (10) is held in place by the cartridge cover (1). When the projectile exits the cartridge cover (1) following firing, the insert element (10) is configured to move out of the channel (5) to allow the shield (6) to move into its armed position.

11 Claims, 4 Drawing Sheets

PROJECTILE SAFETY SYSTEM

The present invention relates to a small arms projectile for a small arms weapon having a safety system.

Small arms projectiles for small arms weapons are known in the art. Such small arms projectiles typically comprise a generally tubular casing and have an axially movable firing pin. On impacting a target, the firing pin moves to impact and detonate an initiating charge contained within an initiator. This, in turn, detonates, via a fire channel, a warhead containing the main explosive charge.

Various safety systems/mechanisms have been proposed to avoid accidental detonation of such projectiles. Such safety mechanisms are extremely important to ensure the projectiles can be both safely stored and handled. Indeed, given the potential harm an accidental detonation of such a projectile would cause to surrounding personnel, it is preferred to incorporate a number of safety mechanisms into the projectile design. In this way, multiple fail safes are provided to prevent accidental detonation. At the same time, it is important that the safety mechanisms do not compromise reliable detonation of the projectile when it impacts a target.

The applicant's earlier application, WO 99/51934, discloses one such small arms projectile for a small arms weapon containing a number of such safety mechanisms. Firstly, the initiator is rotatably moveable between safe and armed conditions wherein, when in the safe position, the initiator charge is not aligned with the firing pin or the fire channel. As such, the firing pin cannot easily detonate the initiating charge and, even if the charge is accidentally detonated, it is not aligned with the fire channel to initiate the main explosive charge. The initiator is maintained in this safe position during storage by the firing pin engaging with the side of the initiator, against an arming force tending to urge the initiator towards its armed condition. In turn, the firing pin is held in its safe position, against the resilient force of a spring which is biasing the firing pin away from the initiator into an armed position, by a safety release means comprising first and second mechanical means. The first mechanical means includes a frangible disc element which is frangible in response to the acceleratory forces experienced on firing of the projectile. The second mechanical means includes a safety pin which is held in place by the projectile's fins and is configured to be ejected from the casing under the influence of the resilient force applied to the firing pin once the fins open. When the projectile is fired, the frangible disc is crushed by a base portion located behind the firing pin, which releases the firing pin. As the projectile leaves the weapon, its fins open, which allows the safety pin to be ejected under the resilient force of the spring. This permits the resilient force to then move the firing pin away from the initiator into its armed position, and simultaneously allows the initiator to be urged into its armed condition.

WO 2004/065891, which is also one of the present applicant's earlier applications, discloses a projectile based on the arrangement described above in WO 99/51934, but is provided with a further safety mechanism. In this case, a shielding means is provided between the initiator and explosive charge of the warhead. The shielding means takes the form of a shutter which is slidable between a safe position and an armed position inside a channel formed by a slot positioned between the fire channel and the initiator. The shielding means is provided with an engaging means which engages with the initiator. In the initiator's safe position, the shielding means is also in its safe position where it blocks the fire channel, thereby preventing accidental detonation of the explosive charge. When the projectile is fired and the initiator moves into its armed position, the shielding means is slid along inside its slot, by its engagement with the initiator, into its armed position. This aligns an opening provided in the shielding means with the fire channel, thereby allowing the initiator to initiate detonation of the explosive charge via the fire channel.

The above described safety mechanisms have proved very effective. However, one problem with such mechanisms is that they do not provide an easily visible external indicator that the initiator is in a safe position. That is, once the casing/housing is assembled around the internal components, the person assembling the projectile (the assembler) cannot be sure that the initiator is still held in its safe position. As such projectiles are often assembled by hand, this can be potentially dangerous. A further problem with such mechanisms is that they are interrelated and cooperate with one another. As a consequence, in the event of inadvertent movement of the firing pin into an armed position, the initiator would be allowed to also move into an armed position. At the same time, this would also cause the shielding means to move into an armed position. There is therefore a potential for one faulty component to result in the entire projectile becoming armed. Accordingly, there is a need for further independent safety mechanisms to be incorporated into the projectile.

Accordingly, the present invention seeks to solve the above problems associated with the prior art.

According to a first aspect of the present invention, there is provided a small arms projectile for a small arms weapon, said projectile being provided within a cartridge cover prior to firing and comprising:

a firing pin;

a warhead having an explosive charge;

an initiator being moveable from a safe to an armed position on firing the projectile, and being for detonating the explosive charge when in the armed position and impacted by the firing pin; and wherein the projectile further comprises a release element for preventing movement of the initiator from the safe to the armed position when in an engagement position, said release element being held in said engagement position by the cartridge cover when the projectile is contained there within and being configured for moving out of said engagement position when the projectile exits the cartridge cover and the weapon's barrel following firing.

In this way, provided the projectile is retained in its cartridge cover, the initiator is held in its safe, unarmed, position, thereby preventing its detonation or the detonation of the main explosive charge in the projectile's warhead. When the projectile is fired from a small arms weapon and passes along the weapon's barrel, the release element is retained in its engaged position by the bore of the weapon's barrel until it exits the barrel. On exit from the barrel, the release element is released, permitting the initiator to then move into an armed position. As such, the present invention provides an independent bore riding safety mechanism to prevent the accidental detonation of the main explosive charge prior to firing and exit from the barrel. Furthermore, during assembly, prior to the projectile being inserted into the cartridge cover, the above arrangement also enables an assembler to easily determine if the initiator is in its safe position by the location of the release element.

Conveniently, said release element is resiliently biased away from said engagement position. In this way, as soon as the restraint of the cartridge cover is removed and the projectile exits the barrel, the release element moves out of the engaged position and releases the initiator allowing it to move into the armed position.

Conveniently, said release element comprises a spring.

In one embodiment, said release element comprises a C shaped spring. Conveniently, said release element is configured to engage with the exterior of the projectile's body, the engagement surface of the projectile's body being configured such that the resilience of the release element against it urges the release element radially outward.

Conveniently, the projectile comprises an aperture formed in its body and, when in an engagement position, said release element projecting from the exterior of the projectile's body into the interior thereof for engagement with the initiator.

Preferably, said aperture is configured for restraining the disconnection of the release element from the projectile when the projectile exits said cartridge cover. This prevents the release element being expelled from the projectile after firing which could otherwise cause injury to surrounding personnel.

Preferably, said release element comprises a hooked formation for restraining the disconnection of the release element from the projectile.

In an embodiment, said projectile further comprises:

a channel formed between the initiator and the explosive charge;

shielding means being slidable along said channel from a safe position, in which the shielding means shields the explosive charge from the initiator, to an armed position in which the initiator is capable of detonating the explosive charge; and an insert element for location in said channel when the shielding means is in a safe position for preventing movement of the shielding means from the safe to the armed position, said insert element being held in said channel by the cartridge cover and being configured for moving out of said channel when the projectile exits the cartridge cover and the weapon's barrel following firing.

In this way, a second independent safety mechanism is provided which independently prevents the shielding means from moving to an armed position when the projectile is still contained within its cartridge cover or the weapon's barrel. Furthermore, in embodiments where the shielding means is engaged with the initiator, this prevention of the movement of the shielding means would also act to prevent the movement of the initiator into the armed position. Conversely, the release element would prevent movement of the shielding means into the armed position by preventing movement of the initiator.

According to a second aspect of the present invention, there is provided a small arms projectile for a small arms weapon, said projectile being provided within a cartridge cover prior to firing and comprising:

a firing pin a warhead having an explosive charge;

an initiator for detonating the explosive charge when impacted by the firing pin;

a channel formed between the initiator and the explosive charge; and shielding means being slidable along said channel from a safe position, in which the shielding means shields the explosive charge from the initiator, to an armed position in which the initiator is capable of detonating the explosive charge;

wherein the projectile further comprises an insert element for location in said channel when the shielding means is in a safe position for preventing movement of the shielding means from the safe to the armed position, said insert element being held in said channel by the cartridge cover and being configured for moving out of said channel when the projectile exits the cartridge cover and the weapon's barrel following firing.

In this way, provided the projectile is retained in its cartridge cover, the insert holds the shielding means in its safe, unarmed, position, thereby preventing the accidental detonation of the main explosive charge, even if the initiator charge were to accidentally detonate. When the projectile is fired from a small arms weapon and passes along the weapon's barrel, the insert is retained in the shutter channel by the bore of the weapon's barrel until it exits the barrel. On exit from the barrel, the insert is released, permitting the shutter to then move into an armed position. As such, the present invention provides an independent bore riding safety mechanism to prevent the accidental detonation of the main explosive charge prior to firing and exit from the barrel. Furthermore, during assembly, prior to the projectile being inserted into the cartridge cover, the above arrangement also enables an assembler to easily determine if the shielding means is in its safe position simply by checking that the insert does not protrude from the projectile's body.

Conveniently, said insert element is moveable out of said channel following firing of the projectile by action of the centripetal forces created by the projectile spinning.

An illustrative example of the present invention will now be described with reference to the accompanying drawings, in which:

FIG. 5 is an axial cross-sectional view of FIG. 6 taken through the safety insert.

Figure 1:
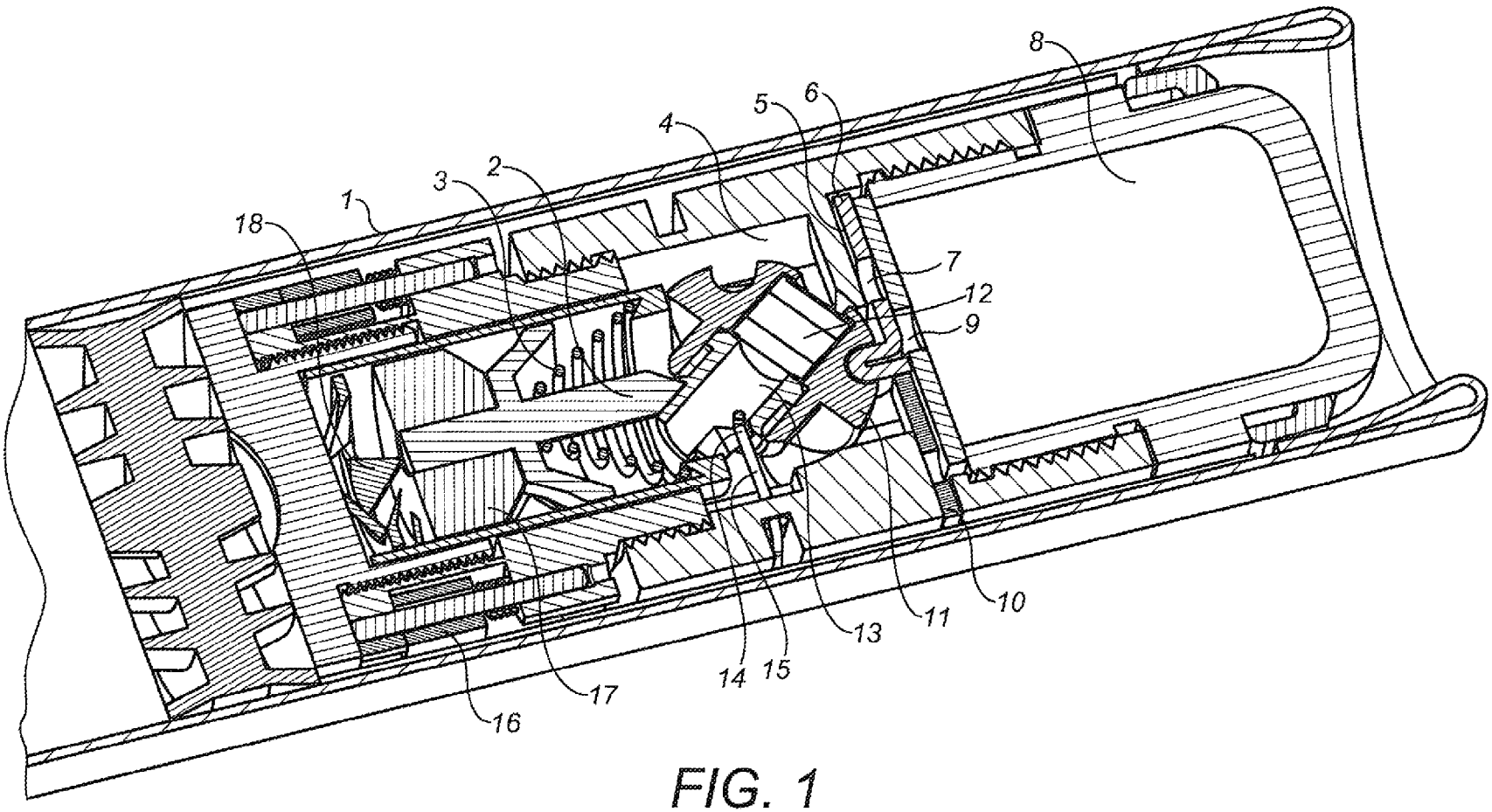
FIG. 1 is a longitudinal cross-sectional view of small arms projectile of an embodiment of the present invention.
Figure 2:
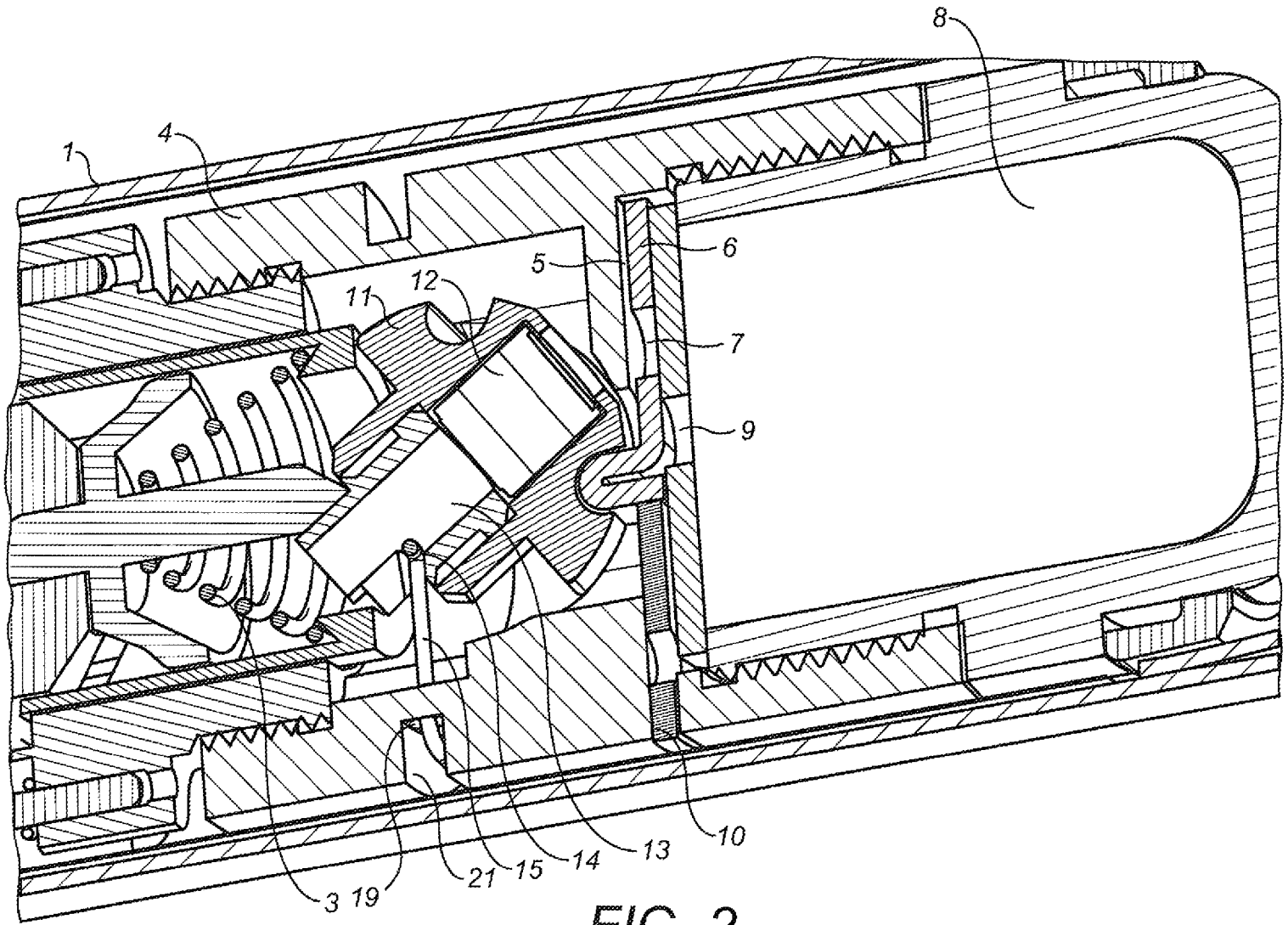
FIG. 2 is an enlarged longitudinal cross-sectional perspective view of a section of the projectile shown in FIG. 1.

Referring to FIGS. 1 and 2, a projectile for a small arms weapon is shown which incorporates some similar features to those described in the applicant's earlier applications WO 99/51934 and WO 2004/065891. The projectile provided within a cartridge 1 along with its propellant charge. The projectile has a housing 4 for housing the components. Fins 16 are provided to the rear of the housing 4, and are folded inwardly against the housing when the projectile is stored in the cartridge 1. An explosive charge 8 is provided at the front of the housing 4.

Figure 6:
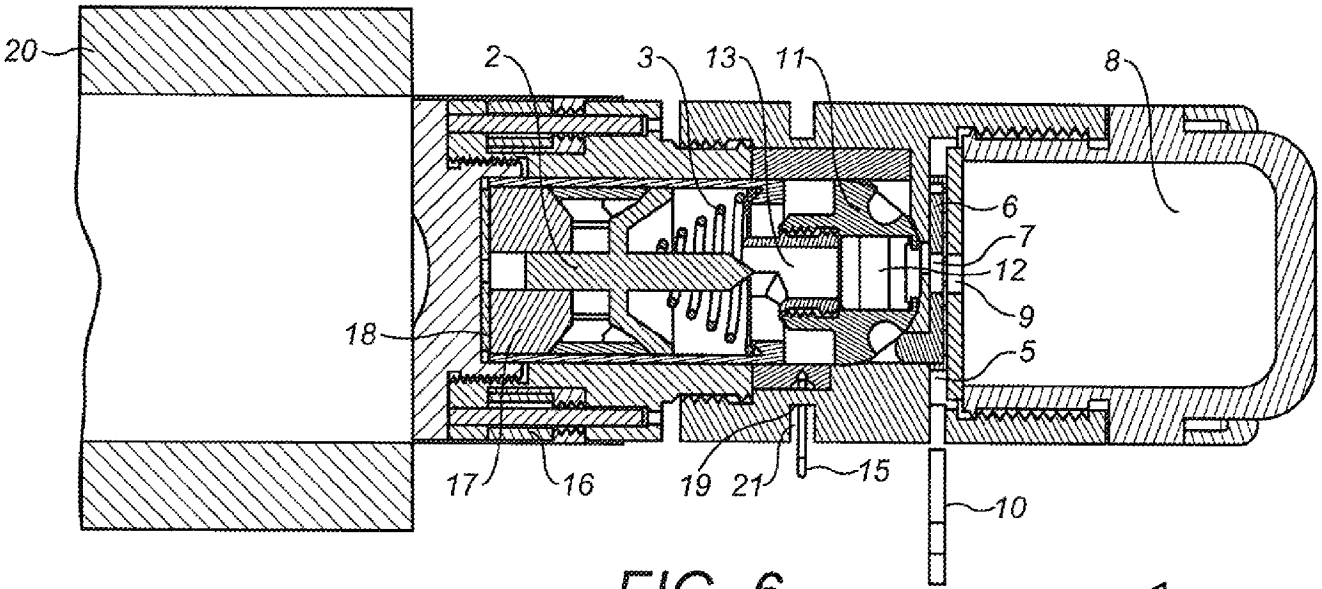
FIG. 6 is a longitudinal cross-sectional view of the projectile shown in FIGS. 1 and 2 immediately after it has emerged from the barrel of a small arms weapon.

The firing pin 2 and initiator 11 arrangement is similar to that disclosed in WO 99/51934 and therefore, for brevity, the function of these features is only summarised below. The firing pin 2 is axial moveable inside the housing 4. In the stored condition, as shown, the firing pin 2 is held in an unarmed safe position by base portion 17, against the bias of spring 3. Base portion 17 is inturn held in place by frangible disc 18. Firing pin 2 further engages with the side of initiator 11, holding it in its safe position, as shown in FIGS. 1 and 2. In this position, the initiator is rotated such that its channel 13 and initiating charge 12 are not aligned with the firing pin 2 or the fire channel 9. As described in WO 99/51934, on firing the projectile, the acceleratory forces cause base portion 17 to move rearwardly, crushing frangible disc 18. This frees firing pin 2 to move axially rearward, under the bias of spring 3, into its armed position. As a consequence, initiator 11 is free to rotate into its armed position (as shown in FIG. 6) under the influence of acceleratory forces or a basing means, thereby aligning its channel 13 and initiating charge 12 with the firing pin 2 and fire channel 9.

Similarly, the shutter/shielding means 6 is similar to that disclosed in WO 2004/065891 and therefore, for brevity, the function of this feature is only summarised below. As can be seen, the shutter 6 is slidably moveable inside slot 5 formed in housing 4 between the fire channel 9 and the initiator 11. The shutter 6 is provided with a projection/engagement means which engages with the initiator 11 such that movement of the initiator 11 between its safe and armed positions moves the shutter 6 between its safe and armed positions. In the safe position, as shown in FIGS. 1 and 2, the shutter 6 is located so as to block fire channel 9 in order to avoid accidental detonation of the explosive charge 8. When the initiator 11 moves into its armed position, shutter 6 is slid along slot 5 so as to align opening 7 provided in the shutter 6 with the fire channel 9. This allows the initiating charge 12 to communicate with the explosive charge 8, thereby permitting detonation.

In addition to the above described safety mechanisms, two further independent safety mechanisms are provided in this embodiment of the present invention, as is described in further detail below.

The first of these mechanisms comprises a release element in the form of safety spring 15. Safety spring 15 is provided in a groove 21 formed on the exterior of the housing 4 and it projects into the interior of housing 4 through aperture 19 formed in the groove 21. In the interior of the housing 4, the safety spring 15 abuts against abutment formed in the side of channel 13 of the initiator 11. This engagement of safety spring 15 with abutment 14 prevents the initiator 11 from rotating and thereby holds it in its safe position.

Figure 4:
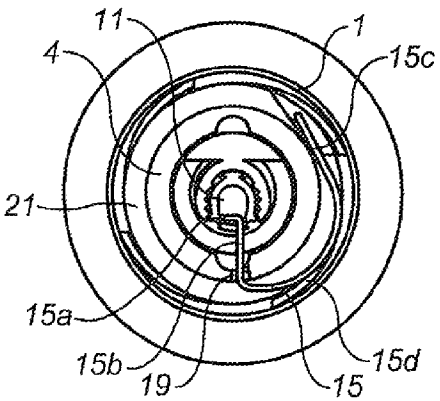
FIG. 4 is an axial cross-sectional view of FIG. 3 taken through the safety spring.

FIG. 4 is an axial cross sectional view through the projectile showing safety spring 15 and the initiator 11 in their safe positions. As can be seen, the safety spring 15 is provided with a hooked engagement surface 15*a* which engages with abutment 14 of initiator 11. From here, the safety spring 15 has an extension section 15*b* which extends outwardly through aperture 19 to the exterior of housing 4. Externally, the safety spring 15 forms a looped section 15*c* around the outside of the housing 4, inside groove 21. The safety spring 15 is biased so as to urge itself radially outward. In this embodiment, this is achieved by the end of looped section 15*c* being biased into engagement with the exterior of housing 4, towards hooked engagement surface 15*a*. As such, the force applied by the ends of safety spring 15 against the curved surfaces of the housing 4 urge the spring 15 radially outward. During storage and prior to firing the projectile, the safety spring 15 is prevented from moving outwardly by its engagement at surface 15*d* with the cartridge cover 1 which surrounds the projectile. This therefore holds the safety spring 15 into engagement with the abutment 14, maintaining the initiator 11 in its safe position. As such, the initiator cannot move into an armed position when the projectile is still contained within the cartridge 1 as it is prevented from doing so by safety spring 15.

In connection with the above, during assembly, an assembler can introduce safety spring 15 through aperture 19. Provided the extension section 15*b* is able to fully insert into the housing, the assembler can be assured that the initiator 11 is in its safe position. This is because if the initiator were not in the safe position, abutment 14 would not be positioned relative to aperture 19 to allow the safety spring to engage with it. Instead, the safety spring 15 would abut against the side of the initiator 11 and hence extension section 15*b* would not fit fully into the housing 4 so that looped section 15*c* lies against the external surface of the housing. Advantageously, this provides a helpful visual indicator for the assembler. Once inserted, the safety spring 15 can be held in position by sliding the cartridge 1 up over the projectile body, and hence the initiator 11 is held in the safe position.

The second safety mechanism incorporated into this projectile comprises insert 10 which fits into slot 5 formed in housing 4 and in which shutter 6 is slidable. The insert 10 is sized such that, when inserted into slot 5, it engages with the shutter 6 and maintains it in its safe position, such that its opening 7 is not aligned with fire channel 9. During storage and prior to firing the projectile, the insert is prevented from dropping out of slot 5 by the cartridge 1 surrounding the projectile. As such, the shutter 6 cannot move into an armed position when the projectile is still contained within the cartridge 1, as it is prevented from doing so by insert 10.

During assembly, the assembler can introduce insert 10 into slot 5 and, provided it is fully received into the slot 5, the assembler can be assured that the shutter 6 has been moved to the safe position, thereby blocking fire channel 9. Advantageously, this provides a helpful visual indicator to the assembler since the assembler can easily tell if the insert 10 protrudes from the housing 4. As with the safety spring, once inserted, the insert 10 can be held in position by sliding the cartridge 1 up over the projectile body, and hence the shutter 6 is held in the safe position.

The operation of the above safety mechanisms in the event of an intended firing of the projectile will now be described.

Figure 3:
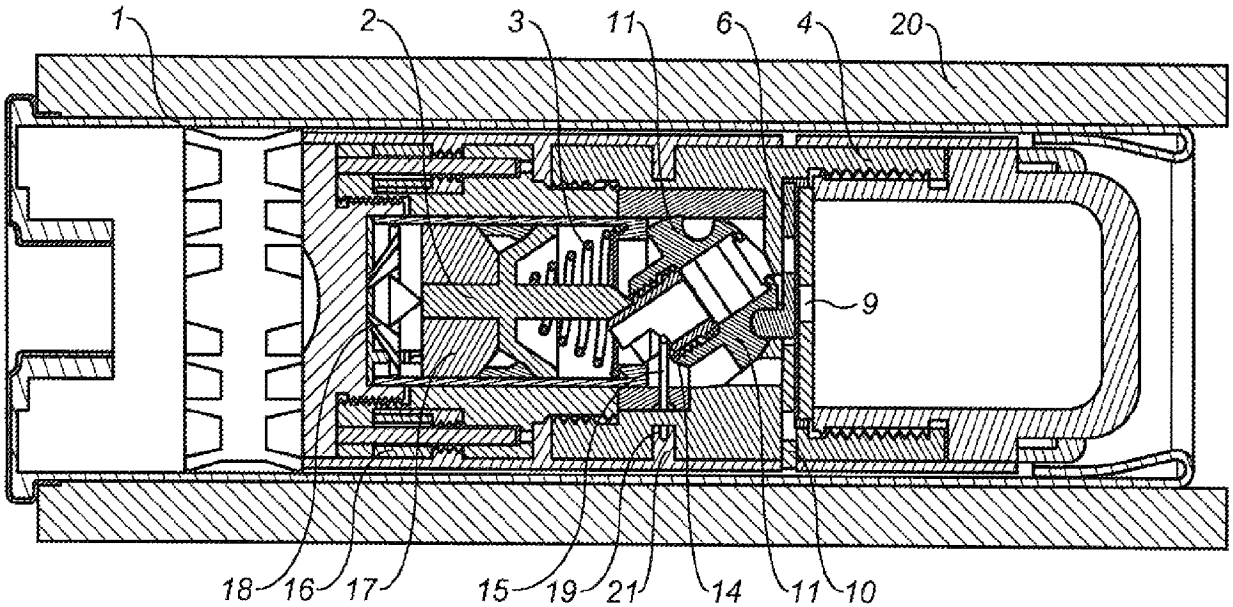
FIG. 3 is a longitudinal cross-sectional view of the projectile shown in FIGS. 1 and 2 when it is located in the barrel of a small arms weapon.
Figure 5:
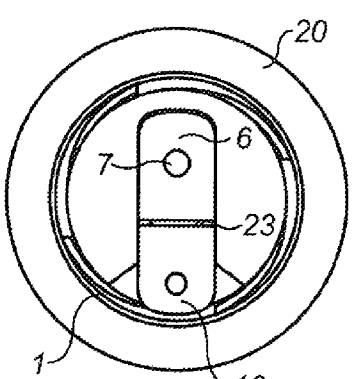
FIG. 5 is an axial cross-sectional view of FIG. 3 taken through the safety insert.

FIGS. 3, 4 and 5 show cross-sectional views of the projectile when it is in the barrel 20 of a small arms weapon prior to firing. As can be seen, in this situation, the projectile is still inside cartridge cover 1 and the safety mechanisms are in their safe positions, as described above in reference to FIGS. 1 and 2. In particular, safety spring 15 is engaged with abutment 14 of initiator 11, as shown in FIG. 4. At the same time, as shown in FIG. 5, insert 10 is fully inserted inside slot 5 ensuring shutter 6 is maintained in its safe position.

After firing the projectile, but whist the projectile is still contained in the weapon's barrel 20, the safety spring 15 and insert 10 are independently maintained in their safe positions by engagement with the bore of the weapon's barrel 20. That is, safety spring 15 is prevented from being released as the projectile passes along the barrel by its engagement with the inner surface of barrel 20. Similarly, insert 10 is prevented from dropping out of channel 5 as the projectile passes along the barrel by the presence of the inner surface of barrel 20. As a consequence, the explosive charge of the projectile is prevented from prematurely detonating inside the weapon's barrel.

Figure 8:
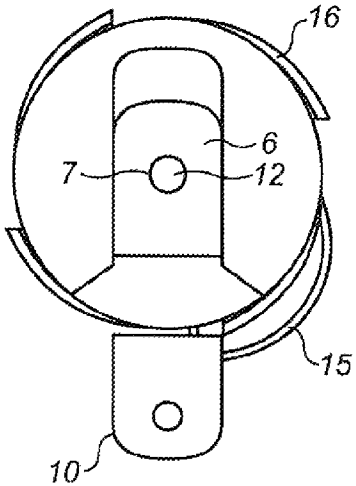
Figure 7:
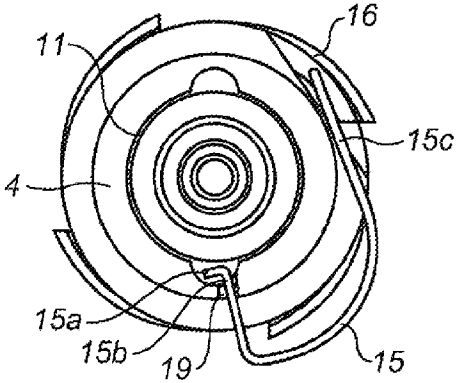
FIG. 7 is an axial cross-sectional view of FIG. 6 taken through the safety spring.

FIGS. 6, 7 and 8 show cross sectional views corresponding to FIGS. 3, 4 and 5 but, in this case, when the projectile has just exited the barrel 20 of the small arms weapon. As can be seen, the acceleratory forces have caused base portion 17 to move rearwardly, crushing frangible disc 18. This allows firing pin 2 to move rearwardly into an armed position by the action of spring 3. This disengages the firing pin 2 from its engagement with the side of initiator 11.

At the same time as the above, the projectile has exited the cartridge cover 1 and the confines of barrel 20. As a consequence, safety spring 15 is released causing it to spring radially outwardly. This occurs by action of the bias of the safety spring 15, although the centripetal forces caused by the projectile spinning may aid this process. As the safety spring 15 moves radially outwardly, the hooked engagement surface 15*a* moves out of engagement with abutment 14, thereby releasing initiator 11. The safety spring 15 is prevented from detaching from the projectile entirely by hooked engagement surface 15*a* engaging with aperture 19, as shown in FIG. 7.

This prevents the safety spring being thrown outwards at high velocity, which could otherwise harm adjacent personnel when the projectile is fired. As the safety spring 15 is relatively thin and light, it does not substantially affect the projectile's aerodynamic properties or flight stability, even if the safely spring 15 is partially exposed from groove 21 after it is released from the safe position.

At the same time as the above, once the projectile has exited its cartridge and the confines of barrel 11, insert 10 is released. At this point, the fins 16 of the projectile have begun to open, which forces the projectile into a spin so as to improve flight accuracy. As a consequence of this spinning action, centripetal forces are exerted on the insert 10, causing it to be expelled radially outwardly from the slot 5, as shown in FIGS. 6 and 8. As a result, shutter 6 is able to move into its armed position so as to align opening 7 with fire channel 9 for allowing initiating charge 12 to communicate with the explosive charge 8.

Accordingly, unrestrained by the safety spring 15 and the firing pin 2, initiator 11 is able to rotate into its armed position which in turn forces the unrestrained shutter 6 into its armed position. On impacting a target, the firing pin is then able to overcome the bias of the spring 3 and move axially forward to slide through channel 13 of the initiator 11 in order to impact initiating charge 12. This causes the detonation of the initiating charge 12, which is in communication with the explosive charge 8 via shutter opening 7 and fire channel 9, resulting in the explosive charge 8 being detonated.

As will be understood from the above, with the two safety mechanisms of the safety spring 15 and insert 10, the explosive charge 8 is prevented from detonating when the projectile is still contained within the cartridge 1 prior to firing and while the projectile is still in the weapon's barrel. That is, the first mechanism independently prevents the initiator 11 from rotating into an armed position by means of safety spring 15, and the second mechanism independently prevents the shutter 6 from sliding into an armed position by means of insert 10. Accordingly, even if the firing pin 2 were to move into its armed position so as to no longer engage with the side of initiator 11, both the initiator 11 and the shutter 6 are prevented from also moving into an armed position by the cartridge cover 1 prior to firing and the barrel's bore when still in the weapon's barrel. This provides a two-tier fail safe to prevent either the initiating charge 12 or the main explosive charge 8 from detonating accidentally or prematurely.

Furthermore, the above two mechanisms are also independent from the other safety mechanisms incorporated into the projectile, such as the frangible disk retaining the firing pin in a safe position, the rotatable initiator, and the slidable shutter.

It will be understood that the embodiment illustrated above shows one application of the invention only for the purposes of illustration. In practice the invention may be applied to many different configurations, the detailed embodiments being straightforward for those skilled in the art to implement.

For example, it will be understood that the above two safety mechanisms are independent from one another and therefore it is envisaged that either of these mechanisms could be provided without the other. That is, a projectile may be provided with only the safety spring mechanisms for preventing the movement of the initiator, or provided with only the insert mechanism as a shutter blocker for preventing movement of the shutter. In both cases, improved safety over conventional projectiles would be achieved. That said, as both mechanisms work independently, it is preferable for safety reasons to provide both safety mechanisms as a double fail-safe.

Furthermore, it will be understood that although in the above embodiment a safety spring has been used as the release element, this element need not itself be biased outwardly. For example, a clip could be used instead to retain the initiator in a safe position, and the centripetal forces resulting from the spinning of the projectile could be used to force the clip out of engagement with the initiator. Alternatively, the clip could be biased outwardly by an external means. For example, the initiator could be provided with an inclined abutment surface which, under the rotational force applied by the initiator moving into an armed position, forces the clip outwardly.

Moreover, although in the above example the insert moves outwardly solely under the centripetal action of the projectile spinning, it will be understood that a biassing means could be provided to achieve the same effect.

The invention claimed is:

1. A small arms projectile for a small arms weapon, said projectile being provided within a cartridge cover prior to firing and comprising:

a firing pin;

a warhead having an explosive charge;

an initiator being moveable from a safe to an armed position on firing the projectile, and being for detonating the explosive charge when in the armed position and impacted by the firing pin; and wherein the projectile further comprises a release element configured to prevent movement of the initiator from the safe to the armed position when in an engagement position, wherein the release element is configured so that the cartridge cover prevents the release element from moving out of said engagement position when the projectile is provided within the cartridge cover and is configured to move out of the engagement position when the projectile exits the cartridge cover following firing.

2. A small arms projectile according to claim 1, wherein said release element is resiliently biased away from said engagement position.

3. A small arms projectile according to claim 2, wherein said release element comprises a spring.

4. A small arms projectile according to claim 3, wherein said release element comprises a C shaped spring.

5. A small arms projectile according to claim 4, wherein said release element is configured to engage with the exterior of the projectile's body, the engagement surface of the projectile's body being configured such that the resilience of the release element against it urges the release element radially outward.

6. A small arms projectile according to claim 1, wherein the projectile comprises an aperture formed in its body and, when in an engagement position, said release element projecting from the exterior of the projectile's body into the interior thereof for engagement with the initiator.

7. A small arms projectile according to claim 6, wherein said aperture is configured for restraining the disconnection of the release element from the projectile when the projectile exits said cartridge cover.

8. A small arms projectile according to claim 7, wherein said release element comprises a hooked formation for restraining the disconnection of the release element from the projectile.

9. A small arms projectile for a small arms weapon, said projectile being provided within a cartridge cover prior to firing, comprising:

a firing pin;

a warhead having an explosive charge;

an initiator being movable from a safe to an armed position on firing the projectile, and being for detonating the explosive charge when in the armed position and impacted by the firing pin;

a release element configured to prevent movement of the initiator from the safe to the armed position when in an engagement position, wherein the release element is configured so that the cartridge cover prevents the release element from moving out of said engagement position when the projectile is provided within the cartridge cover and is configured to move out of the engagement position when the projectile exits the cartridge cover following firing;

a channel formed between the initiator and the explosive charge;

shielding means being slidable along said channel from a safe position, in which the shielding means shields the explosive charge from the initiator, to an armed position in which the initiator is capable of detonating the explosive charge; and an insert element configured to locate in said channel when the shielding means is in a safe position and being configured to prevent movement of the shielding means from the safe to the armed position, wherein the insert element is configured so that the cartridge cover prevents the insert element from moving out of said channel and is configured to move out of the channel when the projectile exits the cartridge cover following firing.

10. A small arms projectile for a small arms weapon, said projectile being provided within a cartridge cover prior to firing and comprising:

a firing pin;

a warhead having an explosive charge;

an initiator for detonating the explosive charge when impacted by the firing pin;

a channel formed between the initiator and the explosive charge; and shielding means being slidable along said channel from a safe position, in which the shielding means shields the explosive charge from the initiator, to an armed position in which the initiator is capable of detonating the explosive charge;

wherein the projectile further comprises an insert element configured to locate in said channel when the shielding means is in a safe position and being configured to prevent movement of the shielding means from the safe to the armed position, wherein the insert element is configured so that the cartridge cover prevents the insert element from moving out of said channel and is configured to move out of the channel when the projectile exits the cartridge cover following firing.

11. A small arms projectile according to claim 10, wherein said insert element is moveable out of said channel following firing of the projectile by action of the centripetal forces created by the projectile spinning.

* * * * *